US006283664B1

(12) United States Patent
Gueret

(10) Patent No.: US 6,283,664 B1
(45) Date of Patent: Sep. 4, 2001

(54) APPLICATOR OF A POWDER PRODUCT AND A METHOD FOR MANUFACTURING THE APPLICATOR

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/531,319

(22) Filed: Mar. 20, 2000

Related U.S. Application Data

(63) Continuation of application No. 08/921,802, filed on Sep. 2, 1997.

(30) Foreign Application Priority Data

Sep. 2, 1996 (FR) ..... 96 10689

(51) Int. Cl.[7] ..... A47L 13/30
(52) U.S. Cl. ..... 401/261; 401/139

(58) Field of Search ..... 401/261, 262, 401/267, 139; 132/293, 298

(56) References Cited

U.S. PATENT DOCUMENTS 4,341,819 * 7/1982 Schreffler et al. ..... 427/195
4,459,332 * 7/1984 Giglia ..... 428/86
5,180,240 * 1/1993 Gueret ..... 401/88

* cited by examiner

*Primary Examiner*—David J. Walczak
(74) *Attorney, Agent, or Firm*—Oblon, Spivak, McClelland, Maier & Neustadt, P.C.

(57) ABSTRACT

An applicator (1) of a powder product is provided, wherein the applicator has a support (2) at least a portion of the surface of which is covered by a mixture of coating fibers (3) and of both powder (4) and the product to be applied, and a method for manufacturing the applicator and it use to apply cosmetic powders.

15 Claims, 2 Drawing Sheets

APPLICATOR OF A POWDER PRODUCT AND A METHOD FOR MANUFACTURING THE APPLICATOR

This application is a Continuation of application U.S. Ser. No. 08/921,802, filed on Sep. 2, 1997, pending.

The invention concerns applicators of products, in particular for the care and topical treatment of the skin, including the make-up of the skin, nails, hair and of the mucous membranes. The aim of the invention is, in particular, an applicator of powder products that is ready for use, easy to handle, for a one-off use and having an efficiency at least equivalent to that of conventional products. The aim of the invention is, moreover, to provide a device that is easy and economical to make, as well as a method for obtaining the applicator in accordance with the invention. The invention may be applied in particular as a tester, or sampler of cosmetic products, such as care or make-up powders, (colorants, eyeshadows, blushers, kohl, liners, means for concealing rings round the eyes or wrinkles etc.) or such products as are sold in amounts that are easy to carry.

It is known that samples of cosmetic products are made from adhesive strips onto which the product to be tested is sprayed. Moreover, testers are known onto which the powder has previously been pressed, to obtain samples ready for use which have only one coated side. Applicators are also known which have a core comprising a flocked coating whereon a powder is compacted. All these systems have the main drawback that they do not offer a good hold of the powder on its support during carriage. Moreover, during their application to the skin, the transfer is frequently unequal, thus producing a make up of poor quality. Similarly, the ease of application leaves much to be desired.

Figure 1:
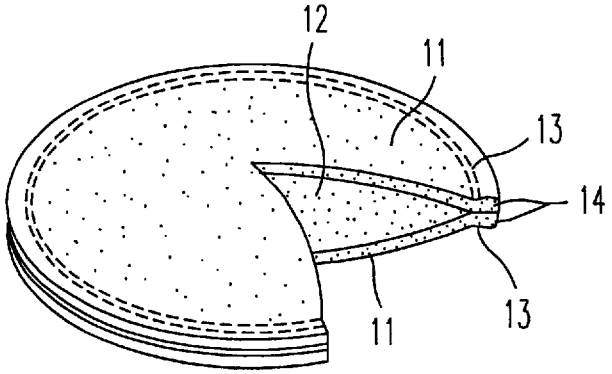
FIG. 1 PRIOR ART

French Patent Application 95/11111 filed on the Sep. 27, 1995 in the name L'Oreal for "A foam puff for the care and topical treatment of the skin" describes, as illustrated in FIG. 1, a foam puff for the care and topical treatment of the skin, nails, hair and of the mucous membranes, constituted by two foam slabs 11, of substantially the same size and contours, superposed edge to edge between which is encapsulated a powder 12 of a cosmetic, dermatological or pharmaceutical product that is soluble or emulsifiable in water, the two slabs 11 being kept joined together by at least one weld 13 in the vicinity of, or on, their periphery 14. However, such a system is not altogether satisfactory in that the restitution of the powder through the meanders of the cells forming the foam is restrained.

Thus one of the objects of the present invention is to create an applicator of a powder product ready for use, not having the above mentioned drawbacks, and providing in particular a good hold of the powder on the applicator during its carriage, as well as a good transfer of the powder during its application to a surface to be treated, thus obtaining a homogeneous application.

Other objects of the present invention will become apparent in detail in the description that follows.

According to a first aspect of the invention, these objects are attained by means of an applicator of a powder product, characterized in that it comprises a support, at least a portion of the surface of which is covered by a flock, said flock being comprised of a mixture of coating fibres and of powder of the product to be applied.

In other words, according to the invention, it has been found that the powder product could be coated on the support, the same way as the coating fibers, i.e, by using the well known flocking technique. Advantageously, the mixture of fibers and powder is coated by electrostatic coating.

The powder is therefore integral part of the flocking. The cost of the applicator is reduced accordingly, by coating both the fibers and the powder during the same step. Besides, due to this coating technique, the holding of the powder especially during transport, is improved. Last, the transferring of the powder, during this application on the surface to be treated is excellent, therefore producing an homogeneous application.

By way of example, the mixture comprises between 0.1 and 40% of the powder of the product, and preferably between 5% and 20% of powder. The support may be made of a paper/textile, plastic, elastomeric or cellular material.

Advantageously, the fibres are nylon, cotton, rayon, polyamide or polyester fibres, or fibres of any mixture of these various categories.

A second aspect of the invention concerns a method for manufacturing an applicator of a powder product, consisting of applying over at least a portion of the surface of a support, a mixture of coating fibres and of powder of the product to be applied, said mixture of fibers and powder being applied by flocking.

Advantageously, the application by flocking includes the following steps:

a) mixing the powder product to be applied, in given proportions, with the coating fibres capable of being electrostatically applied;

b) coating at least a portion of the support with a liquid adhesive;

c) depositing on the surface thus coated, by electrostatic attraction, the mixture obtained in step a) the particles forming the mixture thus being orientated substantially perpendicularly to the surface of the support; and d) causing the support thus covered to pass through drying means.

Advantageously, the powder product is a powder encapsulated with pigments. By way of example, the powder to be used may be a polyethylene powder that is coated with polyurethane or pigments, or a talcum powder coated with urea formaldehyde and pigments. The powder may be porous and impregnated with agents rendering it electrostatic. Again by way of example, the powder may be constituted at least partly by a non-mineral powder of the Rilsan® type (a powder of polyamide 11) or Expansel®.

According to a third aspect of the invention, there is provided an applicator unit for a powder product, characterized in that it comprises an applicator in accordance with the first aspect of the invention.

Such an applicator unit may comprise an applicator, one end of which carries an applicator element formed on a support, the other end forming a gripping means, wherein a cap is provided so as to enclose at least the applicator element.

Figure 2A:
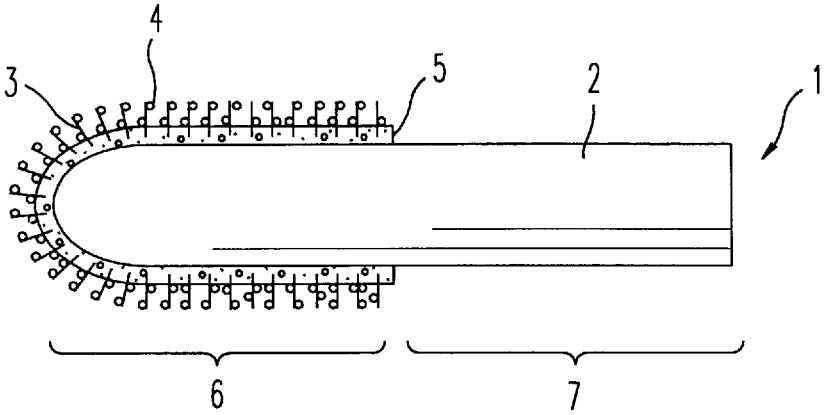
Figure 2B:
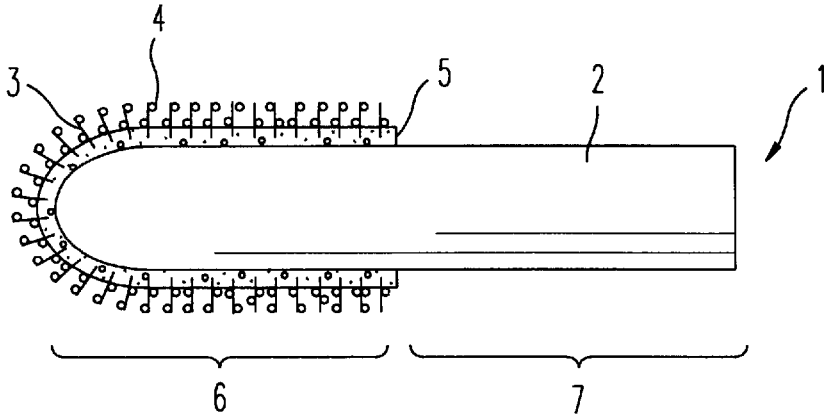
Figure 2C:
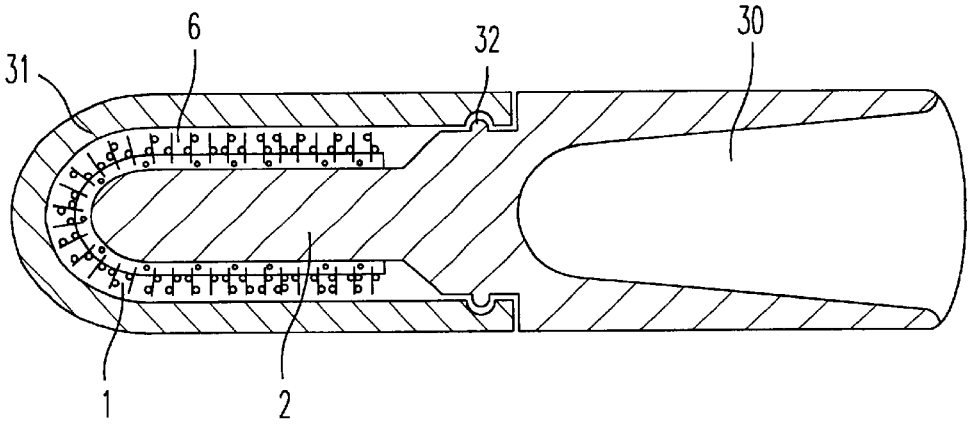
Figure 3A:
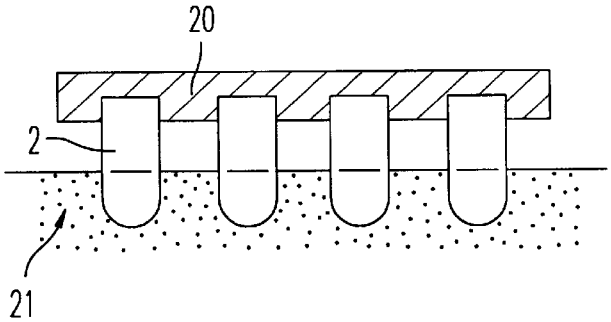
Figure 3B:
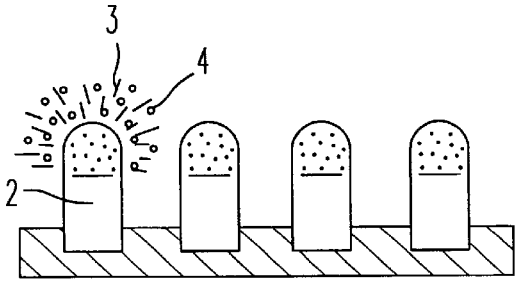
Figure 3C:
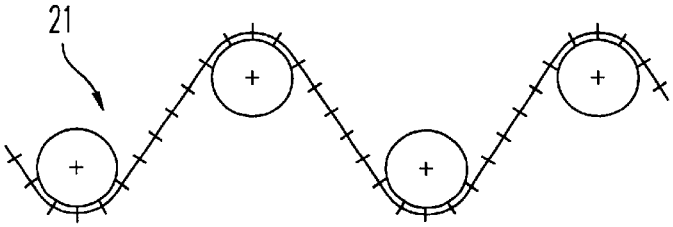

In the following detailed description, reference will be made to the accompanying drawings, wherein FIG. 1 schematically illustrates an applicator such as described in French patent application 95/11111;

FIGS. 2*a*–2*c* show various embodiments of the applicator in accordance with the first aspect of the invention; and FIGS. 3*a*–3*c* illustrate the main steps for manufacturing the applicators in accordance with the first aspect of the invention.

The applicator in accordance with the first aspect of the invention has its origin in the finding that, surprisingly, it was possible to treat a powder particle in the same way as a fibre (or bristle) and to apply it advantageously to a support by the same flocking technique.

FIG. 2*a*, to which reference will now be made, illustrates a longitudinal sectional view of a first embodiment of the applicator 1 in accordance with the invention. This comprises primarily a central core 2 performing the function of a support and capable of assuming various shapes, lengths and thicknesses. In the embodiment shown, the support has an elongate shape, substantially tapered at one of its ends. The support may be made of a plastic, elastomeric, cellular, sintered, textile/paper material, or any other appropriate material. It has over at least a portion of its surface a zone 6 for applying the product obtained in accordance with the invention by the flocking of a mixture of fibres 3 and of powder 4. As shown, the fibres are substantially orientated perpendicularly to the surface of the support, to which they adhere by means of a layer of an adhesive 5. The powder particles 4 are themselves deposited on the support during the same flocking operation. The major portion of the powder particles 4 is situated at the base of the fibres on the support, along which they can rise substantially as far as their end. The fibres are chosen so as to promote the adherence of the powder. By way of example, according to the powder to be charged on the applicator, one will use nylon, rayon, polyamide, polyester fibres etc., or any mixture of such fibres.

In the embodiment shown, one end 7 of the support is bare so as to define a zone for being held by the user, or for being gripped by any appropriate element. The arrangement and size of the holding/application zones is defined in an industrial process, for example, by means of well known masking techniques.

The applicators in accordance with the invention may also be mounted on a handle 30 or any other gripping means, making it possible to facilitate its use. Similarly, the applicator may have a cap 31 capable of covering at least the portion containing the powder. Such a cap advantageously takes the form of a sleeve closed at one of its ends, and whose internal side substantially follows the shape of the applicator. The cap may then be mounted on the applicator, either by screwing or by means of an annular bead cooperating with an annular groove arranged in the applicator. Sealing means 32 may be provided to allow the product to be packaged in a leakproof manner. Similarly, the powder may have the same colour as the colour of the coating fibres, or a different colour.

Typically, the mixture applied by flocking on the support comprises 0.1% to 40% of powder and preferably 5% to 20% of powder. By way of an indication, the powder particles have an average size comprised between 0.5 and 500 $\mu$m, and preferably between 10 $\mu$m and 100 $\mu$m. Such a powder may comprise active agents of fatty bodies, or super absorbing agents to absorb moisture or grease. Again by way of example, the powder may be constituted by a dehydrated emulsion. In the field of cosmetics, we may mention care powders, colorants, products of the eyeshadow type, blushers etc.

FIG. 2*b* shows a variant of the embodiment of FIG. 2*a*, and is distinguished therefrom in that the bristles wherein the powder is incorporated are of different lengths. In the same way, one may use fibres of different kinds and/or diameters, thus making it possible to influence the softness or the application, the quantity of the powder charged on the applicator etc.

Thus when the applicator in accordance with the invention is used, the free powder located primarily at the base of the bristles and along the bristles can be applied to the intended surface. Tests have shown that the applicator in accordance with the invention offers a remarkable hold of the powder on the applicator during its carriage, as well as a better transfer of the powder onto the skin by applying a slight pressure.

FIGS. 3*a*–3*c* illustrate a preferred mode of implementation of the method in accordance with the invention. In a first step (FIG. 3*a*), the support 2 is carried by an appropriate mechanism 20 to the vicinity of a bath 21 of a liquid adhesive into which the application zone of applicator is dipped. By way of example, a water or solvent-based monomeric, acrylic, vinyl adhesive will be used. Alternatively the coating of the support will be obtained by spraying (with a spray gun). The fibre/powder mixture is treated (electrically charged), to allow it to be is applied electrostatically. Depending on the percentage of the powder to be applied, only the fibre coating (flock coating) will be treated, or both the powder and the flock coating at the same time may be treated. The powder may be made suitable for being electrostatically charged, for example, by covering it with particles, binders or pigments capable of being charged. The mixture obtained will now be subjected to agitation by any appropriate means, adjusted however in such a way as not to substantially affect the electrostatic charge of the mixture.

In a second step (FIG. 3*b*), the fibre/powder mixture 3, 4 is applied to the coated portion of the support 2, by applying an electrostatic field. The particles constituting the mixture are suspended in air and are deposited on the impregnated surface of the applicator by electrostatic attraction. Because of this, in the majority of cases, these particles are orientated substantially perpendicularly to the impregnated surface.

Finally, in a third step (FIG. 3*c*), the thus coated element is caused to pass through drying means 21 (for example an oven). In the case of a monomeric adhesive, the drying will permit the polymerization of the adhesive. Advantageously, after cooling, the excess of particles, (both the product powder and the fibres at the same time) are eliminated by suction.

Various types of packaging may be envisaged for such an applicator. By way of example, it may be packaged in thermoformed boat-shaped receptacles having a cover to be opened, or in the form of individual sachets. In the case of an applicator of a substantially elongate shape (of the quill or lead refill type) having one end reserved for the gripping, it is advantageous to provide devices with clips (of the test type), so as to grip the applicator at its untreated portion. The types of packaging are only given by way of an indication. It is obvious that other types are possible according to the shape and use of the applicator.

In the preceding description, reference has been primarily made to preferred embodiments of the invention. It is obvious that variants may be introduced into it without thereby departing from the spirit of the invention, as claimed below.

What is claimed is:

1. An applicator for a product, comprising:

(a) a support, (b) a flock, covering at least a portion of the surface of said support, said flock comprising:

(i) coating fibers, and (ii) a powder.

2. The applicator of claim 1, wherein said flock comprises 0.1–40% of said powder.

3. The applicator of claim 2, wherein said flock comprises 5–20% of said powder.

4. The applicator of claim 1, wherein said support comprises a member selected from the group consisting of plastic, elastomer, textile, paper and cellular material.

5. The applicator of claim 1, wherein said coating fibers comprise a member selected from the group consisting of nylon, rayon, polyamide or polyester.

6. The applicator of claim 1, wherein said coating fibers have different lengths, are made of different materials, or have different diameters.

7. The applicator of claim 1, wherein a portion of the surface of said support is not covered by said flock.

8. The applicator of claim 7, further comprising:

(c) a cap, and (d) a seal.

9. The applicator of claim 1, wherein said powder has an average particle size of 0.5–500 $\mu$m.

10. The applicator of claim 9, wherein said powder has an average particle size of 10–100 $\mu$m.

11. The applicator of claim 1, wherein said powder has a color different from the color of said coating fibers.

12. The applicator of claim 1, wherein said product is a make-up foundation, a blush, an eyeshadow, a product for effacing wrinkles or rings around the eyes, or a kohl.

13. The applicator of claim 1, wherein said powder is encapsulated with pigment.

14. An applicator unit, comprising the applicator of claim 1.

15. The applicator unit of claim 14 wherein a portion of the surface of said support is not covered by said flock and forms a grip, and the applicator unit further comprises a cap, enclosing said flock in a leak-proof manner.

* * * * *